US006976438B2

(12) United States Patent
Lou-Hao

(10) Patent No.: US 6,976,438 B2
(45) Date of Patent: Dec. 20, 2005

(54) TABLE WITH CORNER LEG MOUNT

(75) Inventor: Leng Lou-Hao, Xiamen (CN)

(73) Assignee: Cosco Management, Inc., Wilmington, DE (US)

( * ) Notice: Subject to any disclaimer, the term of this patent is extended or adjusted under 35 U.S.C. 154(b) by 218 days.

(21) Appl. No.: 10/636,401

(22) Filed: Aug. 7, 2003

(65) Prior Publication Data

US 2004/0200390 A1 Oct. 14, 2004

(30) Foreign Application Priority Data

Apr. 10, 2003 (CN) ..... 3216317 A
May 13, 2003 (CN) ..... 3112398 A
May 13, 2003 (CN) ..... 3217148 A
May 13, 2003 (CN) ..... 3217149 A
May 13, 2003 (CN) ..... 3217150 A

(51) Int. Cl.[7] ..... A47B 3/00
(52) U.S. Cl. ..... 108/129
(58) Field of Search ..... 108/125, 126, 108/129, 132, 127, 131, 130; 248/188.1

(56) References Cited

U.S. PATENT DOCUMENTS 1,064,286 A 6/1913 Campbell
1,705,347 A 3/1929 Vaughan
1,727,833 A 9/1929 Kress et al.
1,783,556 A 12/1930 Bauer
1,901,105 A 3/1933 Kovats
1,987,767 A 1/1935 Beiger
2,075,778 A 3/1937 Johannsen
2,385,717 A 9/1945 Mayer
2,625,454 A * 1/1953 Brown ..... 108/125
2,643,926 A 6/1953 Pucci
2,715,558 A * 8/1955 Lander ..... 108/129
3,464,373 A 9/1969 Larson
4,658,735 A 4/1987 Holton
5,390,610 A 2/1995 Gutgsell
5,528,997 A 6/1996 Miller
5,562,051 A 10/1996 Rizzi
5,606,922 A 3/1997 Adams et al.
5,636,578 A 6/1997 Rizzi
5,913,272 A 6/1999 Gutgsell et al.
5,941,181 A 8/1999 Hornberger et al.
6,401,631 B1 6/2002 Kane et al.
6,508,184 B1 1/2003 Winter et al.

FOREIGN PATENT DOCUMENTS

GB 2218625 A * 11/1989 ..... A47B 3/087

OTHER PUBLICATIONS

Two photo-images of a table (2001).

* cited by examiner

*Primary Examiner*—Jose V. Chen
(74) *Attorney, Agent, or Firm*—Barnes & Thornburg LLP

(57) ABSTRACT

A table includes a table top, a leg, and a corner leg mount. The corner leg mount is arranged to mount the leg adjacent to a corner of the table top for pivotable movement between folded and unfolded positions.

19 Claims, 9 Drawing Sheets

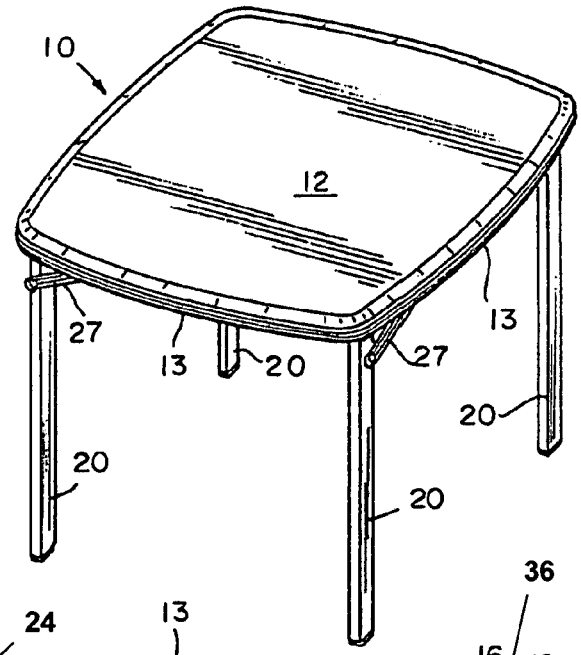
FIG 1
FIG 2
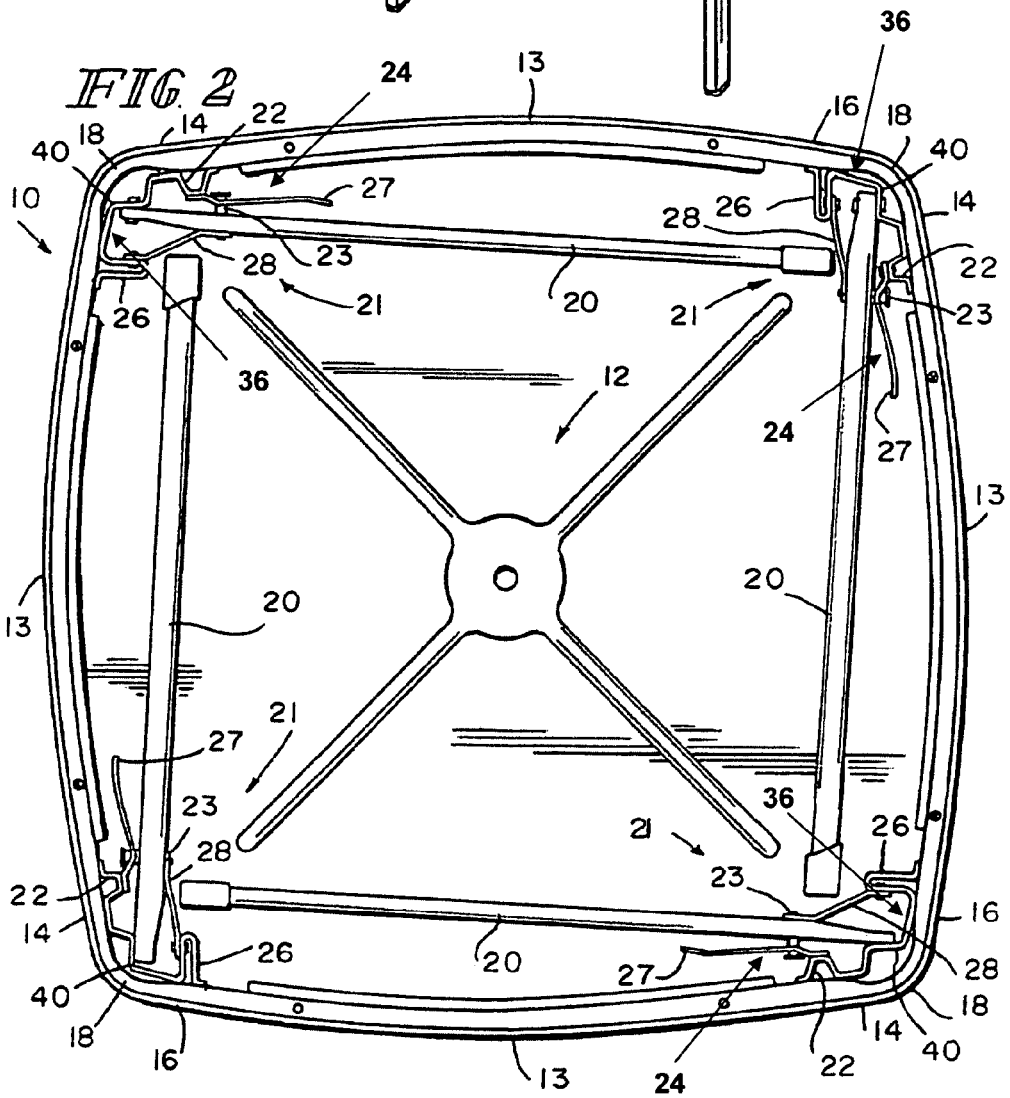

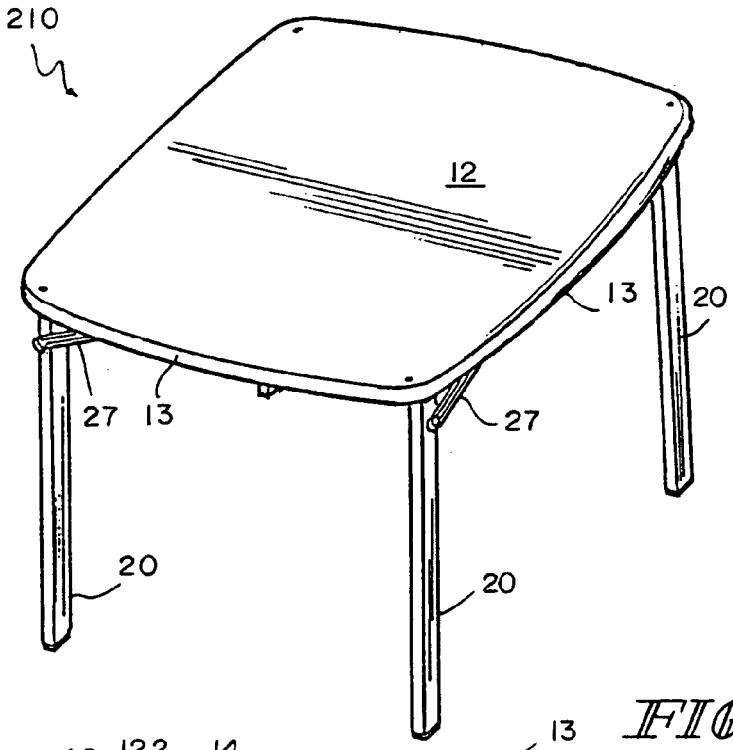
FIG. 6
FIG. 7
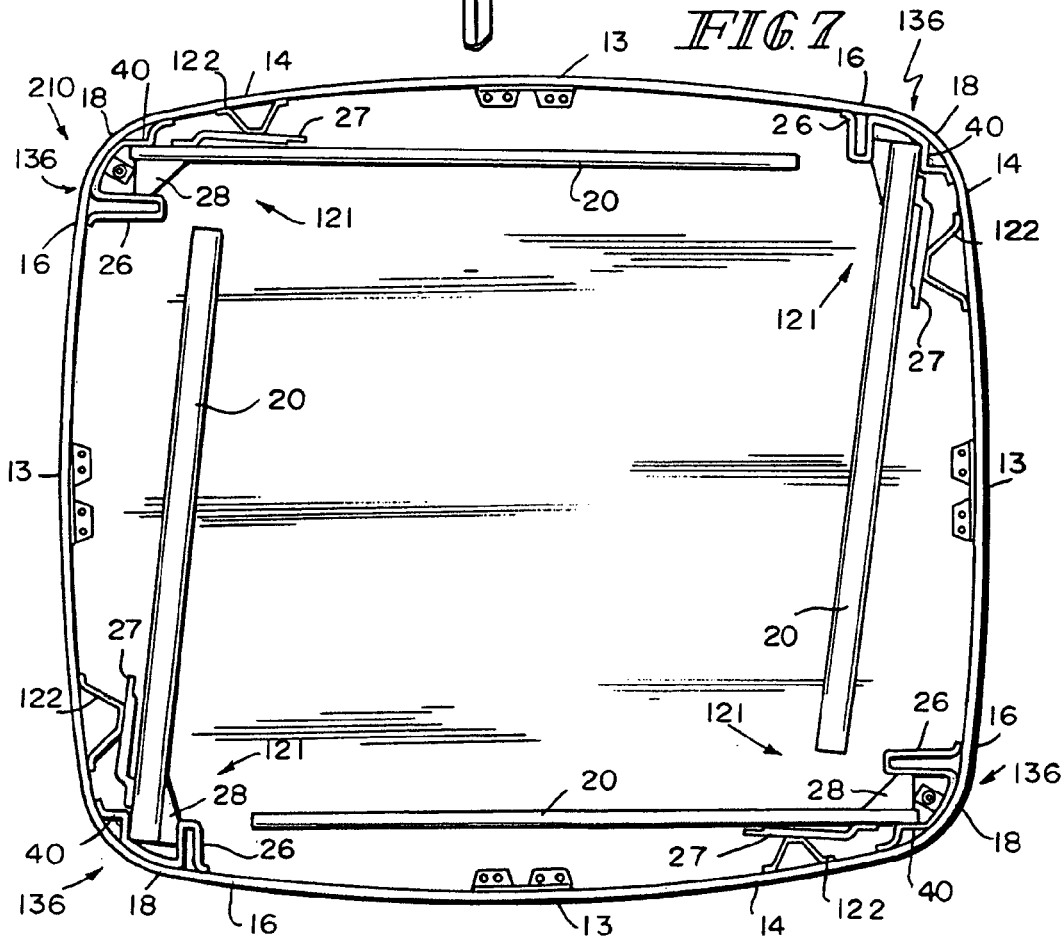

TABLE WITH CORNER LEG MOUNT

Foreign priority is hereby claimed under 35 U. S. C. § 119 to Chinese Patent Application No. 03216317.7 filed in the People's Republic of China on Apr. 10, 2003, and Chinese Patent Application Nos. 03217148.X, 03217149.8, 03217150.1, and 03112398.8 filed in the People's Republic of China on May 13, 2003, the disclosures of which are hereby incorporated by reference herein.

BACKGROUND

The present disclosure relates to tables. More particularly, the present disclosure relates to tables with a corner leg mount to mount a leg adjacent to a corner of the table.

Tables typically include a table top and one or more legs. The legs are used to support the table top and may be mounted in a variety of ways.

SUMMARY

According to the present disclosure, a table includes a table top having a corner between adjacent side rails. A corner leg mount is used to mount a leg adjacent to the corner for movement relative to the table top between folded and unfolded positions.

The corner leg mount includes a pair of bights which may be referred to as a slider mount bight and a strut mount bight. The slider mount bight is coupled to a first of the side rails and the strut mount bight is coupled to a second of the side rails. A slider is coupled to the slider mount bight and the leg and a strut is coupled to the strut mount bight and the leg to facilitate pivotable movement of the leg between the folded and unfolded positions.

A serpentine bracket may be used in the corner leg mount In one embodiment, the serpentine bracket includes both bights and a corner elbow. In other embodiments, the serpentine bracket includes the strut mount bight and a corner elbow but not the slider mount bight which is spaced apart from the serpentine bracket.

Additional features of the apparatus will become apparent to those skilled in the art upon consideration of the following detailed description exemplifying the best mode of the disclosure as presently perceived.

BRIEF DESCRIPTION OF THE DRAWINGS

The detailed description particularly refers to the accompanying figures in which:

FIG. 1 is a perspective view of a table according to the present disclosure showing table legs in an unfolded position;

FIG. 2 is an enlarged plan view of the underside of the table of FIG. 1 showing the legs in a folded position and showing each leg mounted in a corner to a leg mount including a serpentine bracket;

FIG. 6 is a perspective view of another table according to the present disclosure showing its legs in an unfolded position;

FIG. 7 is an enlarged plan view of the underside of the table of FIG. 6 showing the legs in a folded position and showing each leg mounted to a leg mount including a slider mount bight and a serpentine bracket spaced apart from the slider mount bight and including a corner elbow and a strut mount bight;

DETAILED DESCRIPTION

Figure 3:
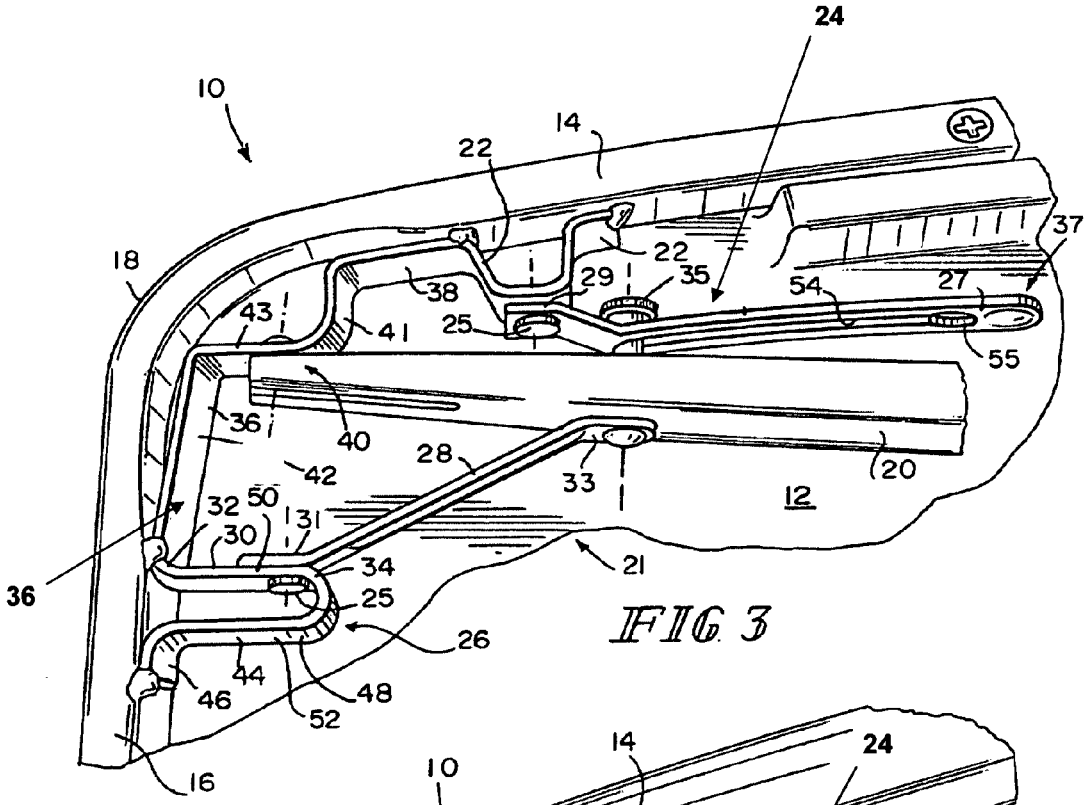
FIG. 3 is a perspective view, with portions broken away, showing the serpentine bracket including a slider mount bight to which a slider is coupled, a corner elbow to which the leg is coupled, and a strut mount bight to which a strut is coupled.

A table 10 includes a table top 12, side rails 13, corners 18 between adjacent side rails 13, legs 20, and corner leg mounts 21 as shown in FIGS. 1–4. Each corner leg mount 21 is used to mount a leg 20 adjacent to one of the corners 18 for pivotable movement relative to the table top 12 between a folded position shown in FIG. 2 and an unfolded position shown in FIG. 1. Tables 110, 210 in accordance with second and third embodiments of the disclosure are shown in FIGS. 6–15.

Corner leg mount 21 includes a serpentine bracket 36, a slider 24, and a strut 28, as shown, for example, in FIGS. 3–6. Serpentine bracket 36 includes, in series, a slider mount bight 22, a first connector wall 38, a corner elbow 40, a second connector wall 42, and a strut mount bight 26. Slider mount bight 22 and first connector wall 38 extend along a first side rail portion 14 of a rail 13. Corner elbow 40 is generally adjacent to corner 18. Second connector wall 42 and strut mount bight 26 extend along a second side rail portion 16 of another rail 13.

Figure 4:
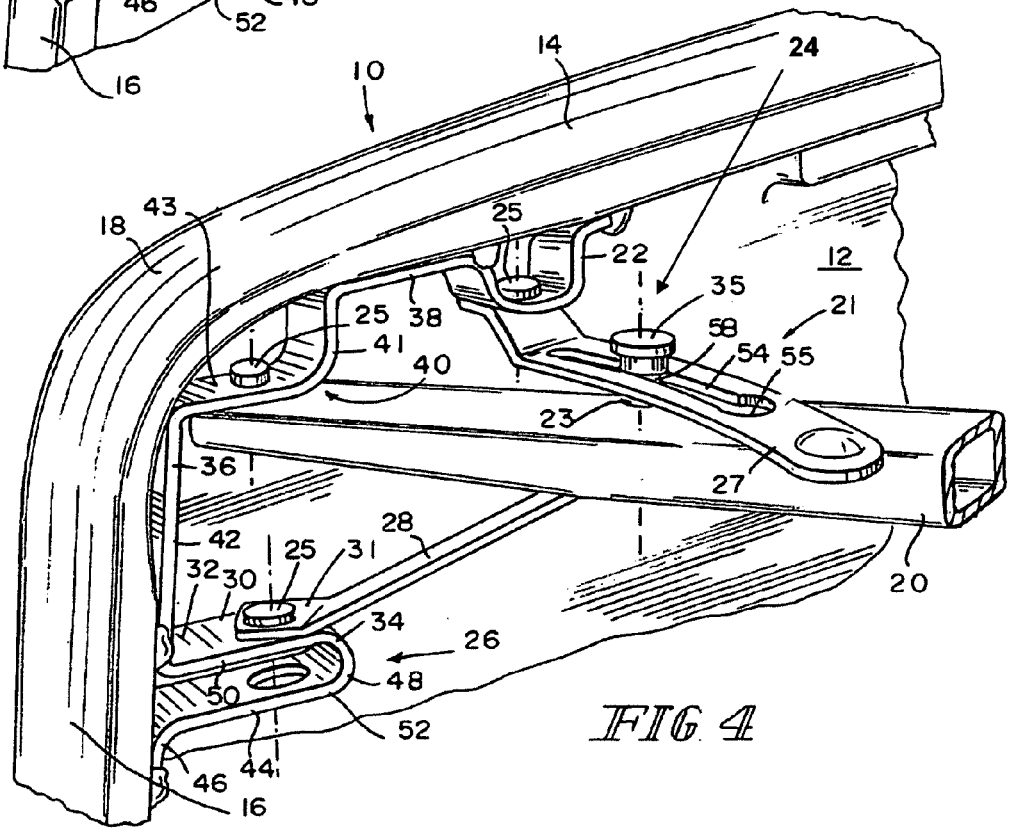
FIG. 4 is a perspective view similar to FIG. 3, showing unfolding of the leg.

Slider mount bight 22 is coupled to and extends inwardly away from the first side rail portion 14, as suggested in FIGS. 3 and 4. Slider 24 is mounted to slider mount bight 22 and leg 20 and includes a pivot axle 25, a guide pin 23, and a slotted link 27. Slotted link 27 is slightly arcuate in shape and is formed with a slot 54 in a middle portion of link 27. Link 27 is coupled to slider mount bight 22 by pivot axle 25 for pivotable movement relative to slider mount bight 22. Slot 54 is formed with a generally round retaining aperture 55 at a distal end portion 37 of link 27. Aperture 55 is formed to engage and retain guide pin 23 upon movement of leg 20 to the unfolded position. Guide pin 23 is formed with a head 35. As shown in FIGS. 3 and 4, head 35 is generally larger in diameter than pin 23 and is formed to nest in retaining aperture 55 when leg 20 is moved to the unfolded position. In the folded position, a shoulder 58 of head 35 acts to compress link 27 toward leg 20. Upon movement of leg 20 to the unfolded position, guide pin 23 moves to the distal end of link 27 through slot 54 and engages and retains head 35 in aperture 55. The retention of head 35 in aperture 55 acts to retain leg 20 in the unfolded position. Guide pin 23 is further coupled to leg 20 and configured to engage link 27 in response to folding and unfolding of leg 20. With respect to leg 20, slider 24 promotes stability of leg 20 upon movement to the unfolded position.

Corner elbow 40 is generally L-shaped and includes a first elbow wall 41 coupled to first connector wall 38, and a second elbow wall 43 coupled to second connector wall 42 as shown best in FIG. 3. Second elbow wall 43 is formed with an aperture 54 and coupled to leg 20 by a pivot axle 25 for pivotable movement of leg 20 relative to corner elbow 40.

Strut mount bight 26 is generally U-shaped and includes a pivot support wall 30 and a reinforcement wall 44 arranged to reinforce pivot support wall 30. Reinforcement wall 44 thus provides means for reinforcing pivot support wall 30 coupled to the second side rail portion 16 shown in FIGS. 3–5.

Pivot support wall 30 includes a first proximal end portion 32 coupled to the second side rail portion 16 and a first distal end portion 34 spaced inwardly from the second side rail portion 16. Pivot support wall 30 further includes a first intermediate portion 50 extending between the first proximal end portion 32 and the first distal end portion 34. With respect to corner leg mount 21, pivot support wall 30 provides means for coupling strut 28 for pivotable movement to stiffen leg 20 in the unfolded position. Reinforcement wall 44 angles from the pivot support wall 30 back toward the second side rail portion 16. Pivot support wall 30 angles from second connector wall 42 away from second side rail portion 16.

Figure 5:
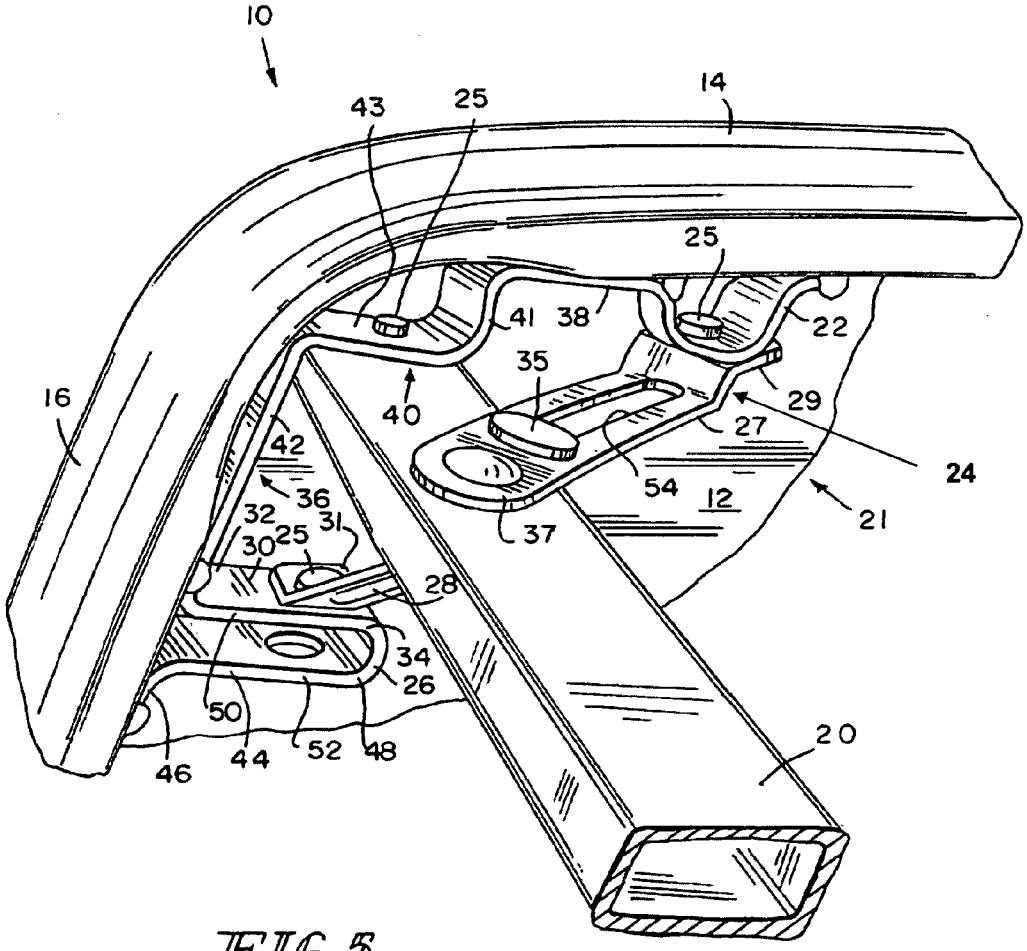
FIG. 5 is a perspective view similar to FIGS. 3 and 4 showing the leg in the unfolded position.
Figure 8:
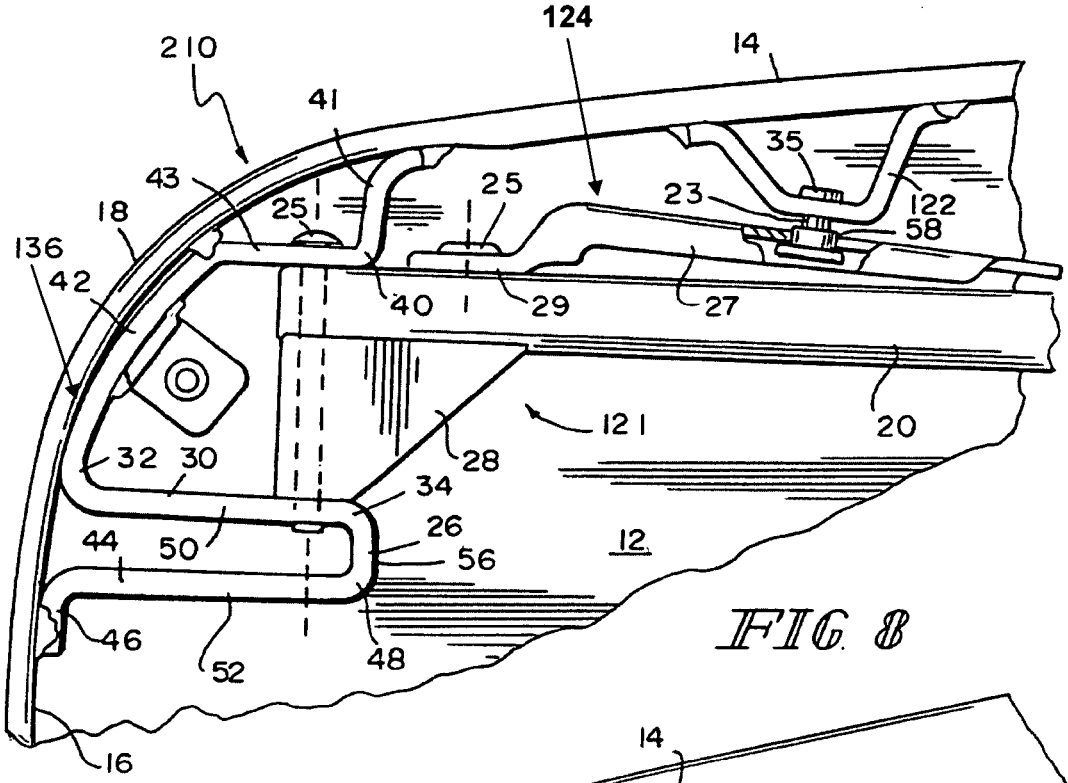
FIG. 8 is a plan view of a corner of the table of FIG. 7, with portions broken away, showing a leg in the folded position.
Figure 9:
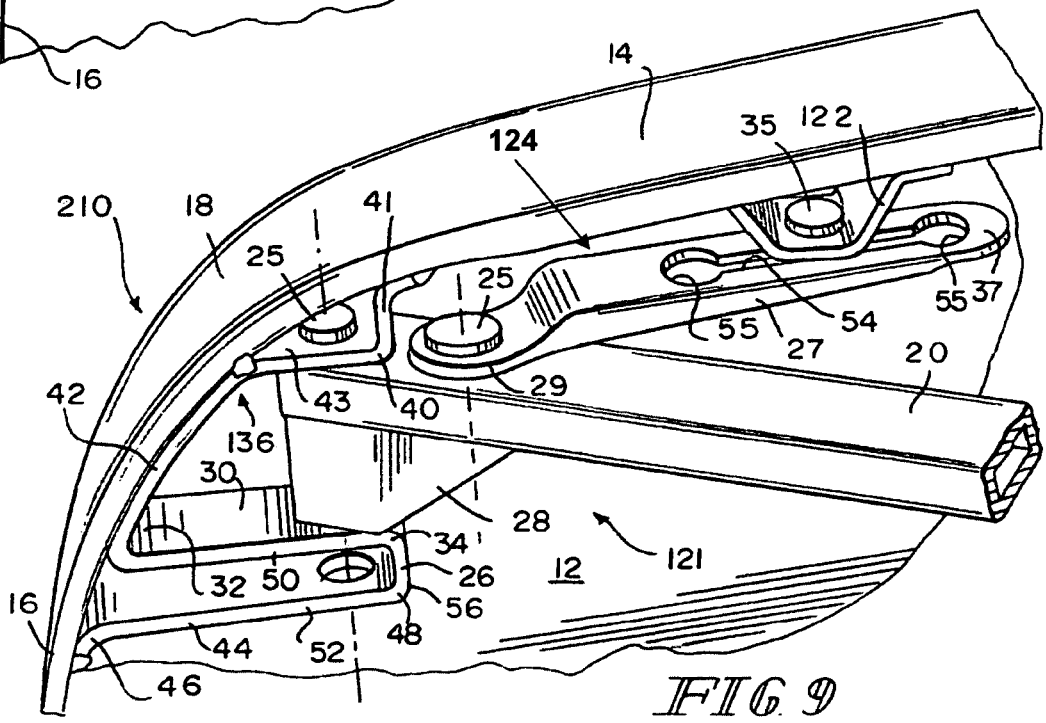
FIG. 9 is a perspective view, with portions broken away, showing unfolding of the leg of FIG. 8.
Figure 10:
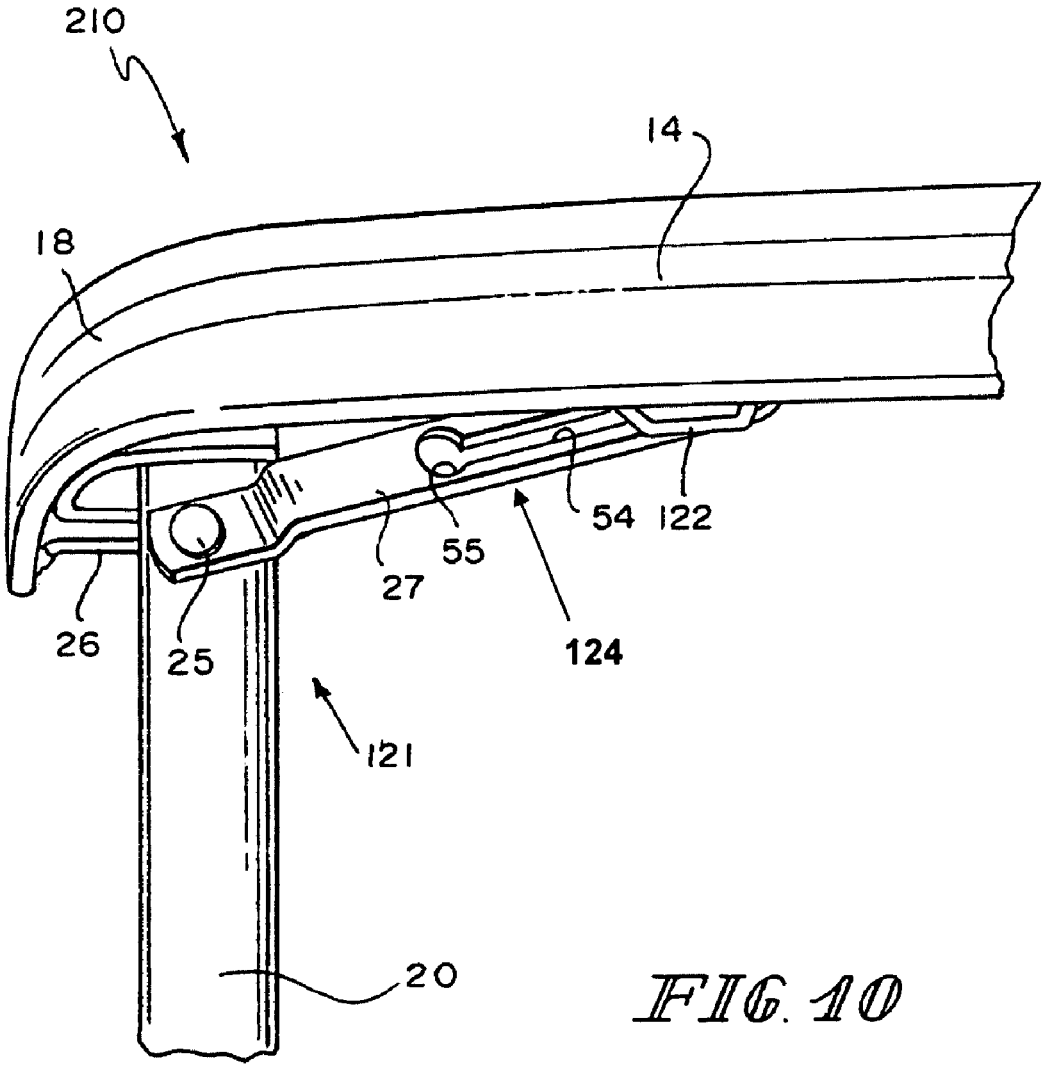
FIG. 10 is a perspective view, with portions broken away, showing the leg of FIGS. 8 and 9 in the unfolded position.
Figure 11:
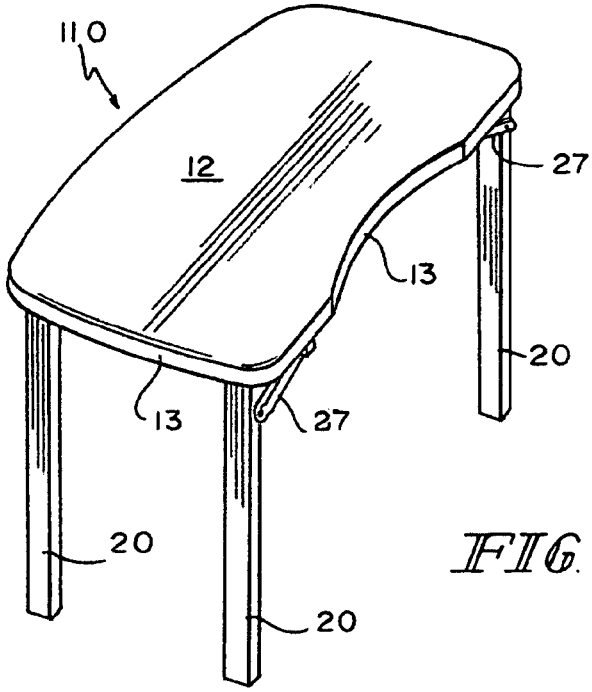
FIG. 11 is a perspective view of another table according to the present disclosure showing its legs in an unfolded position.

Strut 28 is coupled to strut mount bight 26 and leg 20 as shown in FIGS. 3–5. Strut 28 is generally S-shaped and coupled by pivot axle 25 on a first end 31 to pivot support wall 30, and coupled on a second end 33 by an extension of guide pin 23 to leg 20.

Reinforcement wall 44 is used to reinforce pivot support wall 30. In the illustrated embodiment, wall 44 is generally L-shaped and includes a second proximal end portion 46 coupled to second side rail portion 16 and spaced apart from first proximal end portion 32 and a second distal end portion 48 spaced inwardly from second side rail portion 16 and coupled to the first distal end portion 34. Second proximal end portion 46 is curved and provides an end of the serpentine bracket 36. Second distal end portion 48 curves from the first distal end portion 34 to the second intermediate portion 52. Reinforcement wall 44 further includes a second intermediate portion 52 extending between the second proximal end portion 46 and the second distal end portion 48. First intermediate portion 50 and second intermediate portion 52 are parallel to one another.

A second table 110 is shown in FIGS. 6–10 and a third table 210 is shown in FIGS. 11–15. Each table 110, 210 includes a corner leg mount 121 arranged to mount a leg 20 in a corner 18. Corner leg mount 121 includes a serpentine bracket 136 and a slider mount bight 122 detached therefrom.

A strut mount bight 126 and corner elbow 140 are included in bracket 136, as shown in FIGS. 8–9 and 13–15. A strut 128 is coupled to bight 126 and leg 20. Leg 20 is coupled to corner elbow 140. A slider 124 is coupled to leg 20 and slider mount bight 122. A guide pin 23 of slider 124 is coupled to slider mount bight 22. Distal end portion 26 of reinforcement wall 44 of strut mount bight 126 is generally straight.

Figure 12:
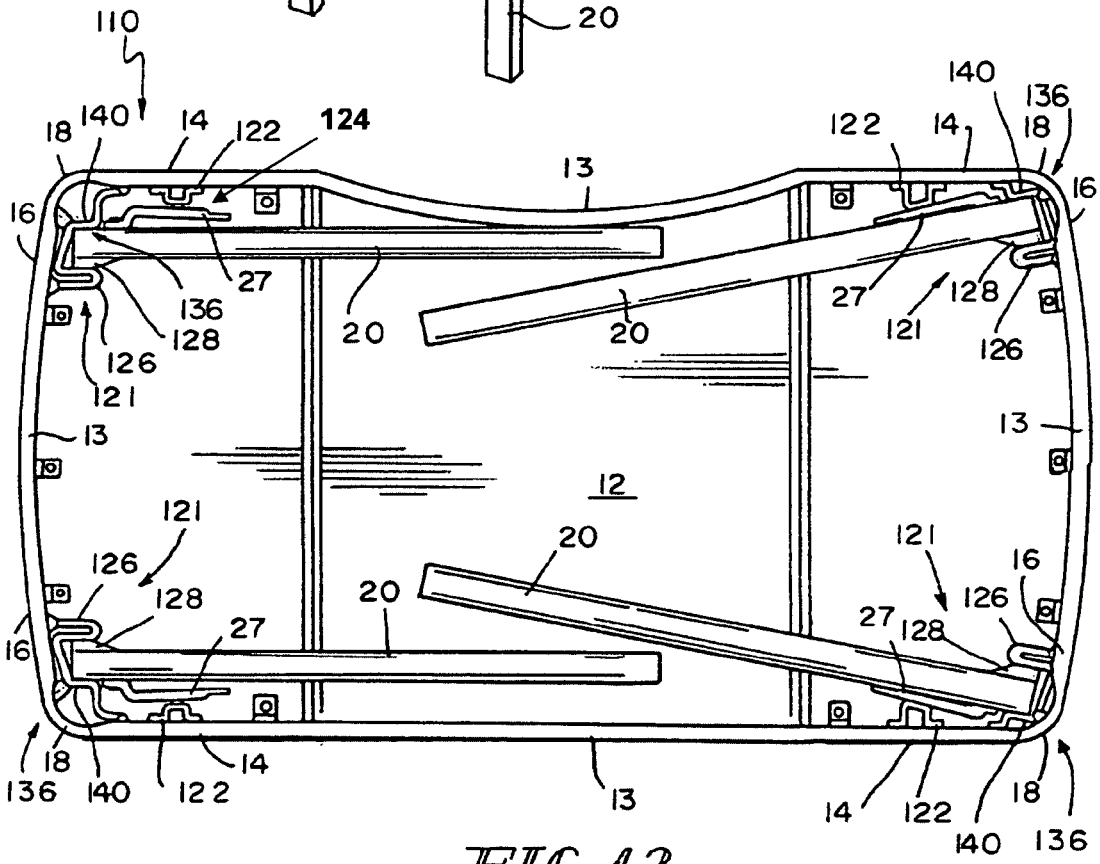
FIG. 12 is an enlarged plan view of an underside of the table of FIG. 11 showing the legs in a folded position showing each leg mounted to a leg mount including a slider mount bight and a serpentine bracket spaced apart from the slider mount bight and including a corner elbow and a strut mount bight.
Figure 13:
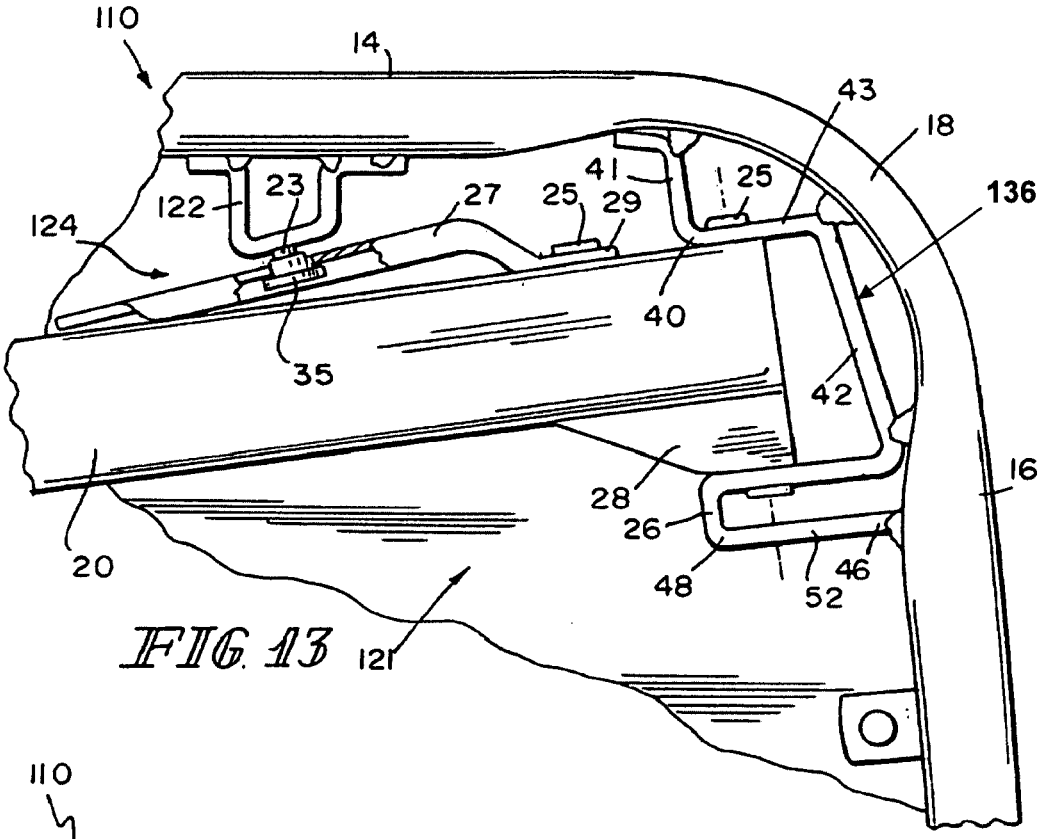
FIG. 13 is a plan view of a corner of the table of FIG. 12, with portions broken away, showing a leg in the folded position.
Figure 14:
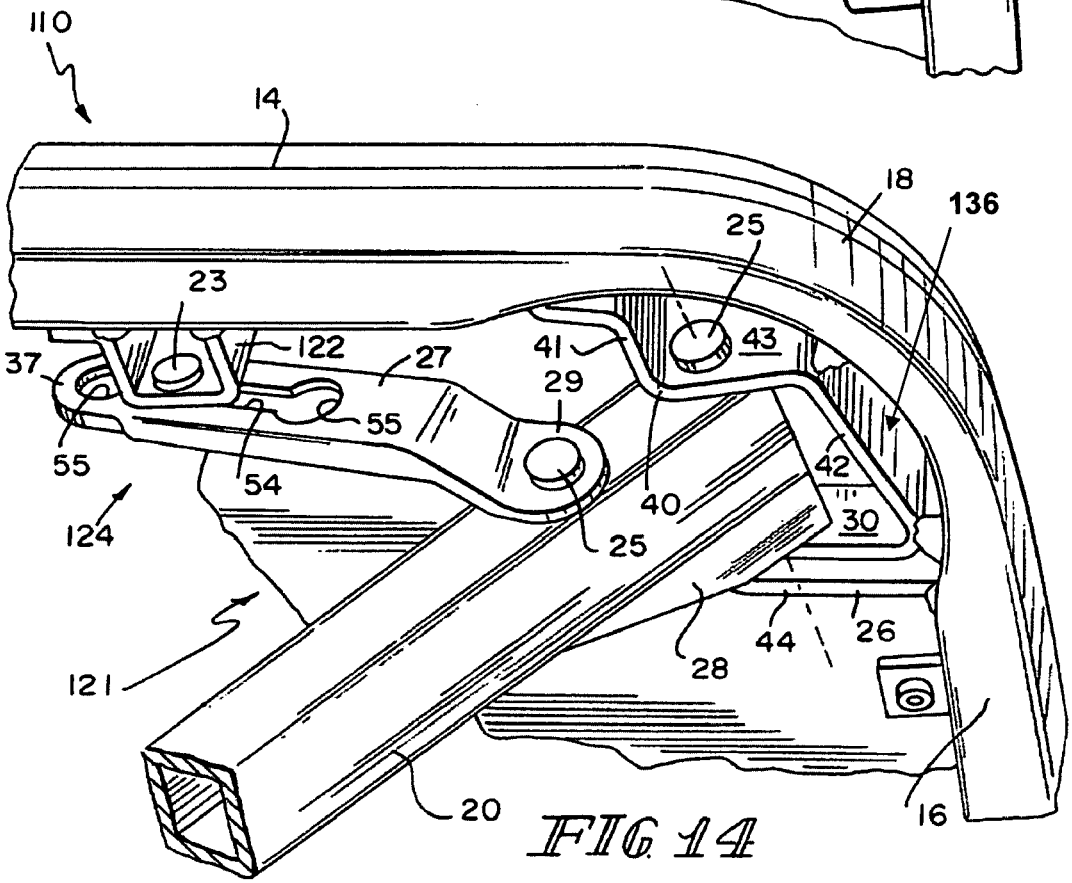
FIG. 14 is a perspective view, with portions broken away, showing unfolding of the leg of FIG. 13.
Figure 15:
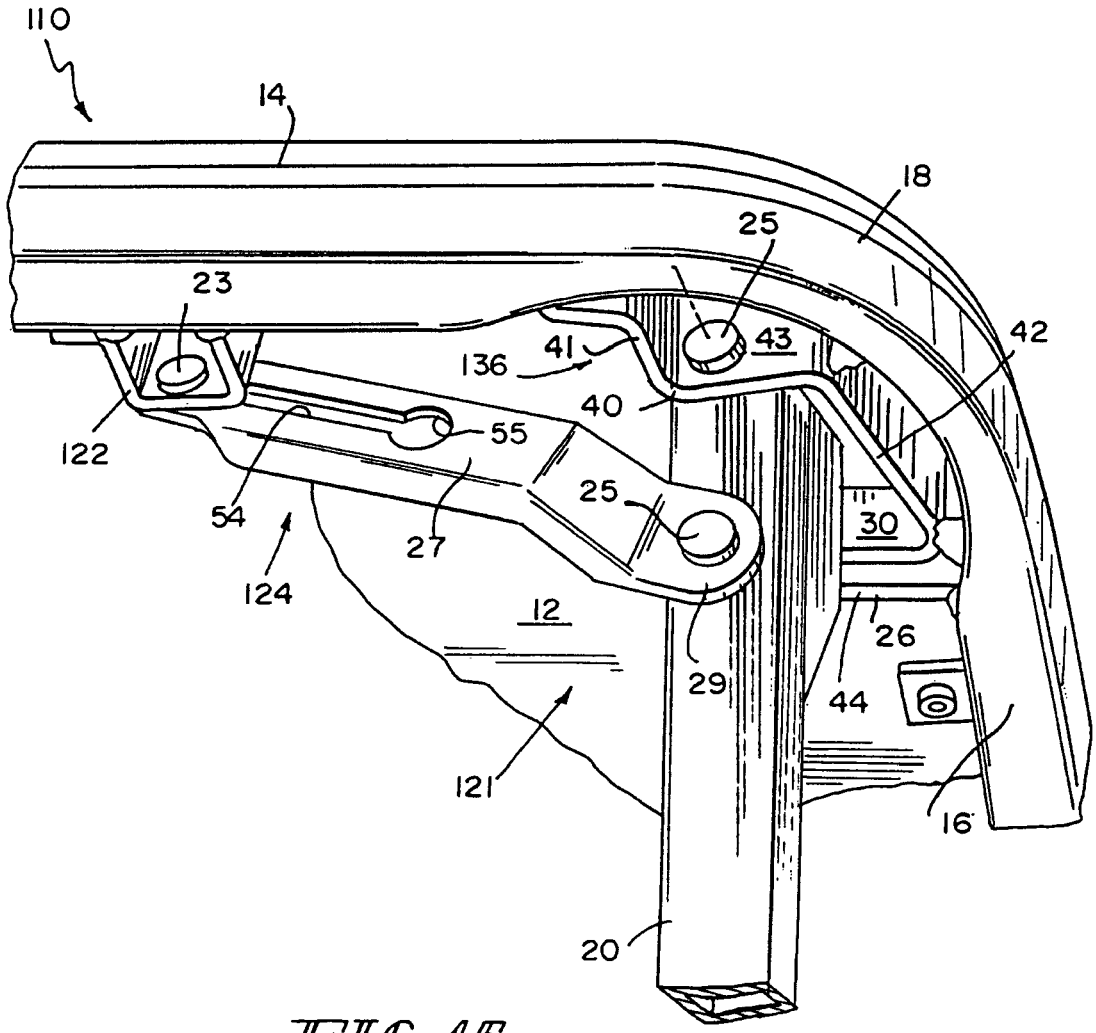
FIG. 15 is a perspective view, with portions broken away, showing the leg of FIGS. 13 and 14 in the unfolded position.

With respect to table 210, two of the four slider mount bights 122 are larger than the other two slider mount bights 122, as shown in FIG. 12. As such, two of the four legs 20 of table 210 are arranged to angle inwardly so that one leg 20 extends between another leg 20 and a side rail 13 along each of the two longitudinal sides of table 210 when legs 20 are folded. Each of corner leg mounts 36, 136 provides means for mounting leg 20 adjacent to corner 18 for pivotable movement of leg 20 relative to table top 12 between folded and unfolded positions.

What is claimed is:

1. A table comprising a table top including first and second side rails and a corner therebetween, a leg, and means for mounting the leg adjacent to the corner for pivotable movement of the leg relative to the table top between folded and unfolded positions, the leg mounting means including a slider mount bight coupled to and extending inwardly away from the first side rail, a slider coupled to the leg and the slider mount bight, a generally U-shaped strut mount bight coupled to and extending inwardly away from the second side rail, and a strut coupled to the leg and the strut mount bight, the strut mount bight including a pivot support wall to which the strut is coupled for pivotable movement and means for reinforcing the pivot support wall.

2. A table comprising a table top including first and second side rails and a corner therebetween, a leg, and means for mounting the leg adjacent to the corner for pivotable movement of the leg relative to the table top between folded and unfolded positions, the leg mounting means including a slider mount bight coupled to and extending inwardly away from the first side rail, a slider coupled to the leg and the slider mount bight, a strut mount bight coupled to and extending inwardly away from the second side rail, and a strut coupled to the leg and the strut mount bight, the strut mount bight including a pivot support wall to which the strut is coupled for pivotable movement and means for reinforcing the pivot support wall, wherein the mounting means includes a serpentine bracket including, in series, the slider mount bight, a first connector wall coupled to the slider mount bight and extending along the first side rail, a corner elbow angling from the first connector wall so as to extend at least partially across the corner inwardly therefrom, a second connector wall angling from the corner elbow and extending along the second side rail, and the strut mount bight in which the pivot support wall angles from the second connector wall away from the second side rail and a reinforcement wall included in the reinforcing means angles from the pivot support wall back toward the second side rail.

3. A table comprising a table top including first and second side rails and a corner therebetween, a leg, and means for mounting the leg adjacent to the corner for pivotable movement of the leg relative to the table top between folded and unfolded positions, the leg mounting means including a slider mount bight coupled to and extending inwardly away from the first side rail, a slider coupled to the leg and the slider mount bight, a strut mount bight coupled to and extending inwardly away from the second side rail, and a strut coupled to the leg and the strut mount bight, the strut mount bight including a pivot support wall to which the strut is coupled for pivotable movement and means for reinforcing the pivot support wall, wherein the corner leg mount includes a serpentine bracket that is spaced apart from the slider mount bight and includes, in series, a corner elbow extending inwardly from the first side rail at least partially across the corner, a connector wall angling from the corner elbow and extending along the second side rail, and the strut mount bight in which the pivot support wall angles from the connector wall away from the second side rail and a reinforcement wall included in the reinforcing means angles from the pivot support wall back toward the second side rail.

4. A table comprising a table top including first and second side rails and a corner therebetween, a leg, and means for mounting the leg adjacent to the corner for pivotable movement of the leg relative to the table top between folded and unfolded positions, the leg mounting means including a slider mount bight coupled to and extending inwardly away from the first side rail, a slider coupled to the leg and the slider mount bight, a strut mount bight coupled to and extending inwardly away from the second side rail, and a strut coupled to the leg and the strut mount bight, the strut mount bight including a pivot support wall to which the strut is coupled for pivotable movement and means for reinforcing the pivot support wall, wherein the reinforcing means includes a reinforcement wall coupled to the second side rail and the pivot support wall.

5. The table of claim 4, wherein the reinforcement wall is generally L-shaped.

6. The table of claim 4, wherein the pivot support wall includes a first proximal end portion coupled to the second side rail and a first distal end portion spaced inwardly from the second side rail and the reinforcement wall includes a second proximal end portion coupled to the second side rail and spaced apart from the first proximal end portion and a second distal end portion spaced inwardly from the second side rail and coupled to the first distal end portion.

7. The table of claim 6, wherein the pivot support wall includes a first intermediate portion extending between the first proximal end portion and the first distal end portion, the reinforcement wall includes a second intermediate portion extending between the second proximal end portion and the second distal end portion, and the first and second intermediate portions are parallel to one another.

8. A table comprising a table top including first and second side rails and a corner therebetween, a leg, and a corner leg mount arranged to mount the leg adjacent to the corner for pivotable movement of the leg relative to the table top between folded and unfolded positions, the corner leg mount including a slider mount bight coupled to and extending inwardly away from the first side rail, a slider coupled to the leg and the slider mount bight, a strut mount bight coupled to and extending inwardly away from the second side rail, and a strut coupled to the leg and the strut mount bight, wherein the strut mount bight is generally U-shaped.

9. A table comprising a table top including first and second side rails and a corner therebetween, a leg, and a corner leg mount arranged to mount the leg adjacent to the corner for pivotable movement of the leg relative to the table top between folded and unfolded positions, the corner leg mount including a slider mount bight coupled to and extending inwardly away from the first side rail, a slider coupled to the leg and the slider mount bight, a strut mount bight coupled to and extending inwardly away from the second side rail, and a strut coupled to the leg and the strut mount bight, wherein the strut mount bight includes a pivot support wall to which the strut is coupled for pivotable movement and that is coupled to the second side rail and a reinforcement wall coupled to the second side rail and the pivot support wall to reinforce the pivot support wall.

10. The table of claim 9, wherein the pivot support wall includes a first proximal end portion coupled to the second side rail and a first distal end portion spaced inwardly from the second side rail and the reinforcement wall includes a second proximal end portion coupled to the second side rail and spaced apart from the first proximal end portion and a second distal end portion spaced inwardly from the second side rail and coupled to the first distal end portion.

11. The table of claim 9, wherein the corner leg mount includes a serpentine bracket including, in series, the slider mount bight, a first connector wall coupled to the slider mount bight and extending along the first side rail, a corner elbow angling from the first connector wall so as to extend at least partially across the corner inwardly therefrom, a second connector wall angling from the corner elbow and extending along the second side rail, and the strut mount bight in which the pivot support wall angles from the second connector wall away from the second side rail and the reinforcement wall angles from the pivot support wall back toward the second side rail.

12. The table of claim 9, wherein the corner leg mount includes a serpentine bracket that is spaced apart from the slider mount bight and includes, in series, a corner elbow extending inwardly from the first side rail at least partially across the corner, a connector wall angling from the corner elbow and extending along the second side rail, and the strut mount bight in which the pivot support wall angles from the connector wall away from the second side rail and the reinforcement wall angles from the pivot support wall back toward the second side rail.

13. A table comprising a table top including first and second side rails and a corner therebetween, a leg, and a corner leg mount arranged to mount the leg adjacent to the corner for pivotable movement of the leg relative to the table top between folded and unfolded positions, the corner leg mount including a corner elbow to which the leg is coupled for pivotable movement and that extends inwardly away from and at least partially across the corner, a slider mount bight coupled to and extending inwardly away from the first side rail, a slider coupled to the leg and the slider mount bight, a strut mount bight coupled to and extending inwardly away from the second side rail, and a strut coupled to the leg and the strut mount bight, the corner elbow and the strut mount bight being included in a serpentine bracket, the strut mount bight including a pivot support wall to which the strut is coupled for pivotable movement and a reinforcement wall arranged to reinforce the pivot support wall, the pivot support wall including a first proximal end portion coupled to the second side rail and a first distal end portion spaced inwardly from the second side rail, the reinforcement wall including a second proximal end portion coupled to the second side rail and a second distal end portion spaced inwardly from the second side rail and coupled to the first distal end portion.

14. The table of claim 13, wherein the pivot support wall is positioned between the reinforcement wall and the corner elbow.

15. The table of claim 13, wherein the serpentine bracket includes a connector wall that is coupled to and angled relative to the pivot support wall and the corner elbow and extends along the second side rail and the pivot support wall is positioned between the connector wall and the reinforcement wall.

16. The table of claim 13, wherein the pivot support wall includes a first intermediate portion extending between the first proximal end portion and the first distal end portion, the reinforcement wall includes a second intermediate portion extending between the second proximal end portion and the second distal end portion, and the first and second intermediate portions are parallel to one another.

17. The table of claim 16, wherein the second distal end portion curves from the first distal end portion to the second intermediate portion.

18. The table of claim 16, wherein the second distal end portion is generally straight and perpendicular to the pivot support wall and the second intermediate portion.

19. The table of claim 16, wherein the second proximal end portion is curved and provides an end of the serpentine bracket.

* * * * *